United States Patent [19]

Hall

[11] Patent Number: 4,836,365

[45] Date of Patent: Jun. 6, 1989

[54] PORTABLE COIN HOLDER AND DISPENSER

[75] Inventor: Morley Hall, Woodmancote, England

[73] Assignee: Minverose Limited, Hampshire, England

[21] Appl. No.: 149,543

[22] Filed: Jan. 28, 1988

[30] Foreign Application Priority Data

Feb. 5, 1987 [GB] United Kingdom ..... 8702597

[51] Int. Cl.[4] ..... A45C 11/28

[52] U.S. Cl. ..... 206/0.83; 206/0.8; 453/50

[58] Field of Search ..... 206/0.8, 0.83, 0.84; 453/50, 52, 53, 54

[56] References Cited

U.S. PATENT DOCUMENTS

| | | | |
|---|---|---|---|
| 765,483 | 7/1904 | Haynes | 453/50 |
| 904,244 | 11/1908 | Birch et al. | 453/50 |
| 1,493,482 | 5/1924 | Edelin | 453/50 |
| 2,147,016 | 2/1939 | Diesing | 453/50 |
| 2,159,999 | 5/1939 | Reichert | 423/268 |
| 2,998,126 | 8/1961 | Jenkins | 206/0.83 |
| 4,540,008 | 9/1985 | Murphy | 206/0.8 |

FOREIGN PATENT DOCUMENTS

| | | | |
|---|---|---|---|
| 1241571 | 6/1967 | Fed. Rep. of Germany | 206/0.83 |
| 511772 | 5/1955 | Italy | 206/0.8 |
| 581020 | 8/1958 | Italy | 206/0.84 |
| 81586 | 4/1953 | Norway | 206/0.8 |
| 250751 | 4/1926 | United Kingdom . | |
| 359909 | 4/1930 | United Kingdom . | |
| 457867 | 9/1935 | United Kingdom . | |
| 668129 | 3/1952 | United Kingdom . | |
| 933743 | 8/1963 | United Kingdom . | |
| 1285121 | 8/1972 | United Kingdom . | |
| 1293281 | 10/1972 | United Kingdom . | |
| 2148039 | 5/1985 | United Kingdom | 453/50 |
| 2159999 | 12/1985 | United Kingdom . | |

*Primary Examiner*—David T. Fidei

*Attorney, Agent, or Firm*—Arnold, White & Durkee

[57] ABSTRACT

A dispensing holder for discs (such as coins) comprises a middle plate and two face plates. Each middle plate and face plate define between them disc-receiving slots having mouths open to the edge of the holder. Each slot is bordered on one side by a finger spring on the middle plate, and on the other side by a face hole in the face plate. Manual depression of the finger spring by pressing on a disc through the appropriate face hole allows the disc to be slid out through the mouth of the slot.

2 Claims, 2 Drawing Sheets

PORTABLE COIN HOLDER AND DISPENSER

This invention provides a portable coin holder and dispenser, to be carried in a purse or pocket, which is a modification of a holder such as forms the subject of our British Patent No. 2,159,999.

SUMMARY OF THE INVENTION

The holder of the present invention provides, for only about 50% increase in thickness, double the capacity of our previous holder.

Accordingly the present invention provides a dispensing holder for discs of a given size (such as coins), comprising a middle plate and two face plates which sandwich and are joined to the middle plate, each face plate and the middle plate defining between them disc-receiving slots having mouths open to edges of the middle plate and respective face plate for insertion and removal of discs, each face plate having at each slot a face hole of a size less than the given disc diameter, and the middle plate having for each slot a finger spring acting towards the face hole to hold a disc in the slot but allow it to be dispensed by manual depression against the spring and sliding through the slot mouth.

In a preferred construction, the middle plate and face plates are moulded from a high quality plastics material, intersecured by short tubular spigots on one face plate passing through holes in the middle plate and snapping into sockets on the other face plate. There may also be matching central-spigots on the face plates adhesively secured together through a central hole in the middle plate.

Preferably, pairs of finger springs are moulded integrally with and respectively off-set to opposite sides of the middle plate towards the corresponding face holes in the face plates. Thus each coin slot between each face plate and the middle plate has its own coin-holding finger spring.

Plates with finger springs could be made separately and secured to the middle plate but this would be an inferior mechanical equivalent as compared with integral moulding.

BRIEF DESCRIPTION OF THE DRAWINGS

The invention is illustrated by way of example on the accompanying drawing, in which.

DESCRIPTION OF THE PREFERRED EMBODIMENT

The holder illustrated is square in plan and will hold eight coins inserted through slots at the corners.

Figure 1:
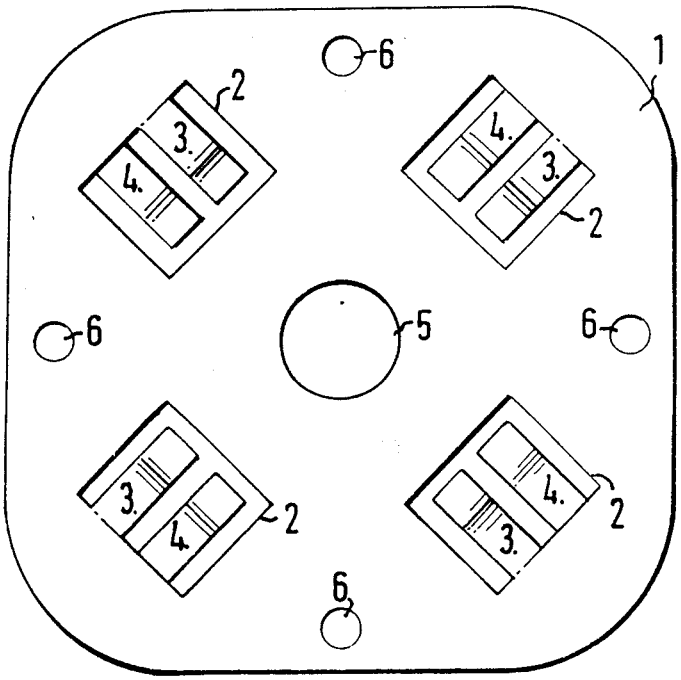
FIG. 1 is a plan of the middle plate. The other side corresponds.
Figure 3:
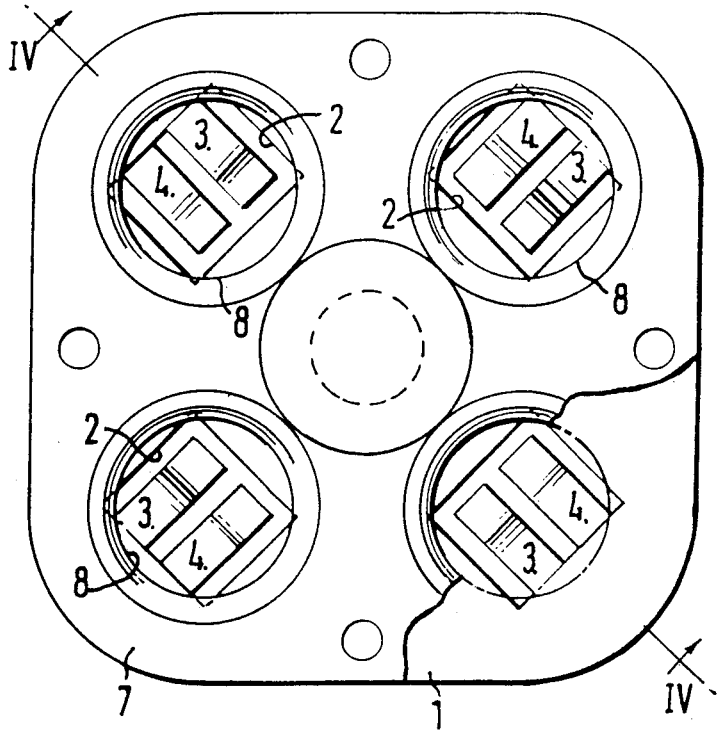
FIG. 3 is a plan of the assembled holder. The other side corresponds.
Figure 4:
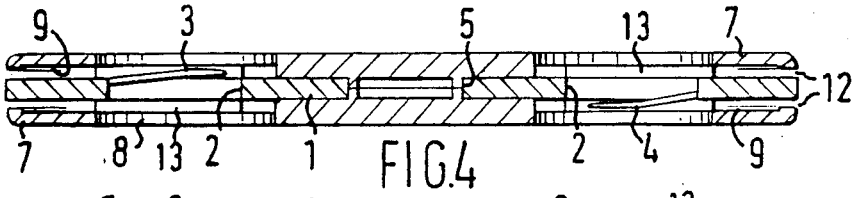
FIG. 4 is a diagonal section on the line IV—IV of FIG. 3.
Figure 5:
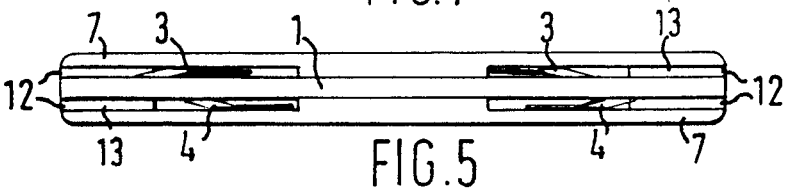
FIG. 5 is an edge view of the holder. The other three edges correspond.

The middle plate 1 (FIG. 1) has across each corner a rectangular opening 2 from the radially outer side of which project a pair of integrally moulded finger springs 3 and 4, each of which is offset to project respectively from one face of the middle plate 1 or the other.

A central hole 5 and four outer holes 6 are provided to accommodate joining spigots of the face plates.

Figure 2:
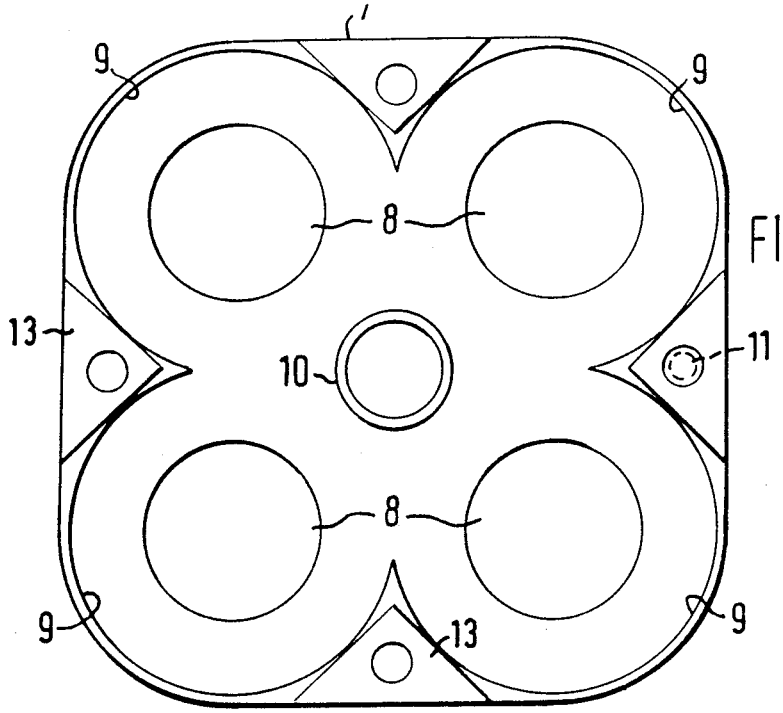
FIG. 2 is an inside plan of a face plate. The other face plate corresponds except for one detail.

As shown by FIG. 2, each face plate 7 has four face holes 8, across each corner respectively; has raised areas 13, to space it from the middle plate; and on the inside a shallow lip 9, around each corner, to serve as a coin retainer. To dispense a coin it must be depressed slightly against its spring to pass the lip 9 before it slides out.

Each face plate has a central annular spigot 10 to be adhesively secured together through the central hole 5 in the middle plate.

At the mid-length of each border, one face plate has a tubular spigot 11 and the other face plate has a socket hole (not shown) into which the respective spigot 11 snaps when the three plates are sandwiched and pressed together.

When the plates are assembled, the shallow lips 9 around each corner leave, at each side of the middle plate 1, a slot 12 for the insertion of a coin to be held by the respective spring 3 or 4 and retained by the lip.

For dispensing, a coin is manually depressed, through its face hole 8, to depress its finger spring and escape past its lip to be slid out through the respective corner slot 12.

The above describes use of the invention in connection with coins. It is to be understood that the term coin is to be interpreted in its broadest sense (e.g. so as to include tokens) and the invention can be used in association with any form of disc for which a holder and dispenser is required.

I claim:

1. A dispensing holder for discs of a given size (such as coins), comprising a single middle plate and two face plates which sandwich and are joined to the middle plate, each face plate and the middle plate defining between them disc-receiving slots having mouths open to edges of the middle plate and respective face plate for insertion and removal of discs, each face plate having at each slot a face hole of a size less than the given disc diameter, the middle plate having for each slot a finger spring acting towards the face hole to hold a disc in the slot but allow it to be dispensed by manual depression against the spring and sliding through the slot mouth, and the middle plate and face plates being intersecured by tubular spigots on one face plate passing through holes in the middle plate and engaging by snap-action sockets on the other face plate.

2. A dispensing holder for discs of a given size (such as coins), comprising a single middle plate and two face plates which sandwich and are joined to the middle plate, each face plate and the middle plate defining between them disc-receiving slots having mouths open to edges of the middle plate and respective face plate for insertion and removal of discs, each face plate having at each slot a face hole of a size less than the given disc diameter, the middle plate having for each slot a finger spring acting towards the face hole to hold a disc in the slot but allow it to be dispensed by manual depression agaisnt the spring and sliding through the slot mouth, and the middle plate and face plates being intersecured by matching centrally disposed spigots on the face plates which are adhesively secured together through a central hole in the middle plate.

* * * * *

UNITED STATES PATENT AND TRADEMARK OFFICE

CERTIFICATE OF CORRECTION

PATENT NO. : 4,836,365

DATED : June 6, 1989

INVENTOR(S) : Morley Hall

It is certified that error appears in the above—identified patent and that said Letters Patent is hereby corrected as shown below:

In the drawings, Figure 2, the numeral that looks like a "1" at the top of the drawing, should be the numeral -- 7 --.

Column 2, line 7, after "plate" and before the semicolon, insert the numeral -- 1 --.

Signed and Sealed this

Thirteenth Day of February, 1990

*Attest:*

JEFFREY M. SAMUELS

*Attesting Officer*

*Acting Commissioner of Patents and Trademarks*